US005868444A

United States Patent [19]

Brackmann et al.

[11] Patent Number: 5,868,444

[45] Date of Patent: Feb. 9, 1999

[54] MOTOR-VEHICLE TRUNK LATCH

[75] Inventors: Horst Brackmann, Velbert; Bernhard Funk, Essen, both of Germany

[73] Assignee: Kiekert AG, Heiligenhaus, Germany

[21] Appl. No.: 928,379

[22] Filed: Sep. 12, 1997

[30] Foreign Application Priority Data

Sep. 21, 1996 [DE] Germany ..... 196 38 701.9
Sep. 2, 1997 [DE] Germany ..... 197 38 265.7

[51] Int. Cl.[6] ..... E05C 3/04

[52] U.S. Cl. ..... 292/201; 292/196; 292/216

[58] Field of Search ..... 292/201, 216, 292/196, 336.3, 341.16, DIG. 23, DIG. 29, DIG. 42

[56] References Cited

U.S. PATENT DOCUMENTS

| | | | |
|---|---|---|---|
| 4,892,339 | 1/1990 | Kleefeldt . | |
| 5,074,603 | 12/1991 | Brackmann | 292/201 |
| 5,180,198 | 1/1993 | Nakamura et al. | 292/201 |
| 5,273,324 | 12/1993 | Kobayashi | 292/216 |
| 5,423,582 | 6/1995 | Kleefeldt | 292/201 |
| 5,474,338 | 12/1995 | Büscher | 292/201 |
| 5,676,003 | 10/1997 | Ursel et al. | 292/201 |

*Primary Examiner*—Steven Meyers
*Assistant Examiner*—Teri Pham
*Attorney, Agent, or Firm*—Herbert Dubno; Andrew Wilford

[57] ABSTRACT

A latch has a bolt mounted a trunk lid, a housing mounted on a motor-vehicle body and having a notch in which the bolt is receivable, and a fork pivotal on the housing about a main axis and displaceable between a closed and an open position. A plate pivoted on the housing at the main axis carries a pawl pivoted on the plate about a pawl axis offset from the main axis and displaceable between a holding position engaging the fork and, in the locked position of same, retaining the fork in the locked position and a releasing position clear of the fork and permitting same to pivot freely. An opening lever pivotal on the plate about a lever axis offset from the main axis is engageable with the pawl and formed with an actuating formation engageable with a formation of a link member displaceable relative to the housing. An electrical actuator coupled to the plate pivots it about the main axis in one direction and thereby, in the holding position of the pawl with the fork in the closed position, pulls the bolt into the notch and in the opposite direction to press the formations against each other and thereby pivot the opening lever against the pawl to put the pawl into the releasing position. A manual actuator connected to the link member presses the formations against each other and thereby pivots the opening lever into engagement with the pawl and pivots the pawl into the releasing position.

6 Claims, 7 Drawing Sheets

MOTOR-VEHICLE TRUNK LATCH

FIELD OF THE INVENTION

The present invention relates to a latch. More particularly this invention concerns a power-actuated trunk latch for a motor vehicle.

BACKGROUND OF THE INVENTION

A standard motor-vehicle trunk latch has as described in commonly owned U.S. Pat. No. 4,892,339 a housing formed with a laterally open recess in which the bolt is receivable, a latch fork formed with a fork seat and with at least one detent, and a fork pivot on the housing supporting the fork for pivoting between a locked and a semilocked position with the seat directed away from the fork pivot and the bolt engaged in the seat and an unlocked position permitting the bolt to enter and exit seat and recess. An operating plate pivotal on the housing about an axis substantially parallel to the fork pivot carries the pivot of a latch pawl which is pivotal on the link plate into and out of a position engaging the detent and thereby retaining the fork in the semilocked position. A motor connected to the operating plate can pivot same about its axis and, when the pawl is engaged with the detent, pivot the fork into the locked position. A door handle and a link connected between the handle and the pawl can pivot same out of engagement with the detent in any position of the fork.

Thus with this system the operating plate is pivoted to power-close the door, thereby pivoting the pawl and using this pawl to push the fork around into the fully locked position. The user of the latch need merely push the door to into the semi-locked position; the motor will take over from here and pull the door fully to into the locked position.

The axis of the operating plate is coaxial with the fork pivot. In this manner the motor force is transmitted with force-multiplying lever action to the fork. In addition the motor carries an orbital crank and a link has one end pivoted on the crank and an other end formed with a slot. A pin on the plate engages in the slot. Thus the plate can move limitedly relative to the link due to the lost motion created by the slot, but the motor will still be able to effectively act virtually directly on the operating plate.

The door handle of this system is a two-arm lever pivotal on the housing between an open and a closed position and has a lower end provided with a pivot coaxial in the open position with the plate pivot axis. The link is pivoted on the pivot of the handle lower end and provided with an opposite end having a slot and the pawl is provided with a pin engaging in the link slot. Furthermore the motor is a small electric motor which, in spite of being a low-wattage unit, can easily pull a door shut with enough force to completely eliminate air or water leaks around it.

While such an arrangement is relatively effective it is fairly complex. Furthermore manual actuation of the latch is difficult and impossible when the latch is partially opened.

OBJECTS OF THE INVENTION

It is therefore an object of the present invention to provide an improved motor-vehicle trunk latch.

Another object is the provision of such an improved motor-vehicle trunk latch which overcomes the above-given disadvantages, that is which is of simple construction and which can be opened manually at all times.

SUMMARY OF THE INVENTION

A latch for securing an edge of a motor-vehicle trunk lid to an edge of a motor-vehicle body has according to the invention a bolt mounted on one of the edges, a latch housing mounted on the other of the edges and having a notch in which the bolt is receivable, and a latch fork pivotal on the housing about a main axis and displaceable between a closed position engaged around the bolt and holding same in the notch and an open position permitting the bolt to enter and leave the notch. An operating plate pivoted on the housing at the main axis carries a pawl pivoted on the operating plate about a pawl axis offset from the main axis and displaceable between a holding position engaging the fork and, in the locked position of same, retaining the fork in the locked position and a releasing position clear of the fork and permitting same to pivot freely about the main axis. An opening lever pivotal on the operating plate about a lever axis offset from the main axis is engageable with the pawl and formed with an actuating formation. A link member displaceable relative to the housing has a formation engageable with the opening-lever formation. A spring urges the link-member formation toward the opening-lever formation. An electrical actuator coupled to the operating plate pivots it about the main axis in one direction and thereby, in the holding position of the pawl with the fork in the closed position, pulls the bolt into the notch and in the opposite direction presses the formations against each other and thereby pivots the opening lever into engagement with the pawl and pivoting the pawl into the releasing position. A manual actuator connected to the link member presses the formations against each other and thereby pivots the opening lever into engagement with the pawl and pivots the pawl into the releasing position.

Thus during power-assisted unlocking of the latch the opening lever is pressed against the formation of the stationary link member to trip it and release the pawl, thereby opening the latch. For manual actuation the link member is itself displaced past the opening lever to pivot same and open the latch. The mechanism is simple and relatively foolproof. Furthermore it can be opened manually if stuck partly open or closed or in the process of opening or closing. The same parts are used for both power-assisted and manual opening and closing, making the mechanism relatively simple while functioning as well as the more complex prior-art systems.

According to the invention the opening-lever formation is an edge of the opening lever and the link-member formation is a pin projecting parallel to the axes from the link member. There is a second formation on the link member and a formation on the fork engageable with each other in the open position of the form to hold the first-mentioned formation of the link member out of engagement with the opening lever. Furthermore the latch fork and operating plate have respective interengageable formations so that the latch can be forced open, if necessary for instance because there is snow on the trunk lid.

In accordance with the invention an abutment is provided on the housing engageable with the link member in a starting position thereof. In addition a two-arm lever pivoted on the housing has one arm pivoted to the link member and another arm connected to the manual actuator.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
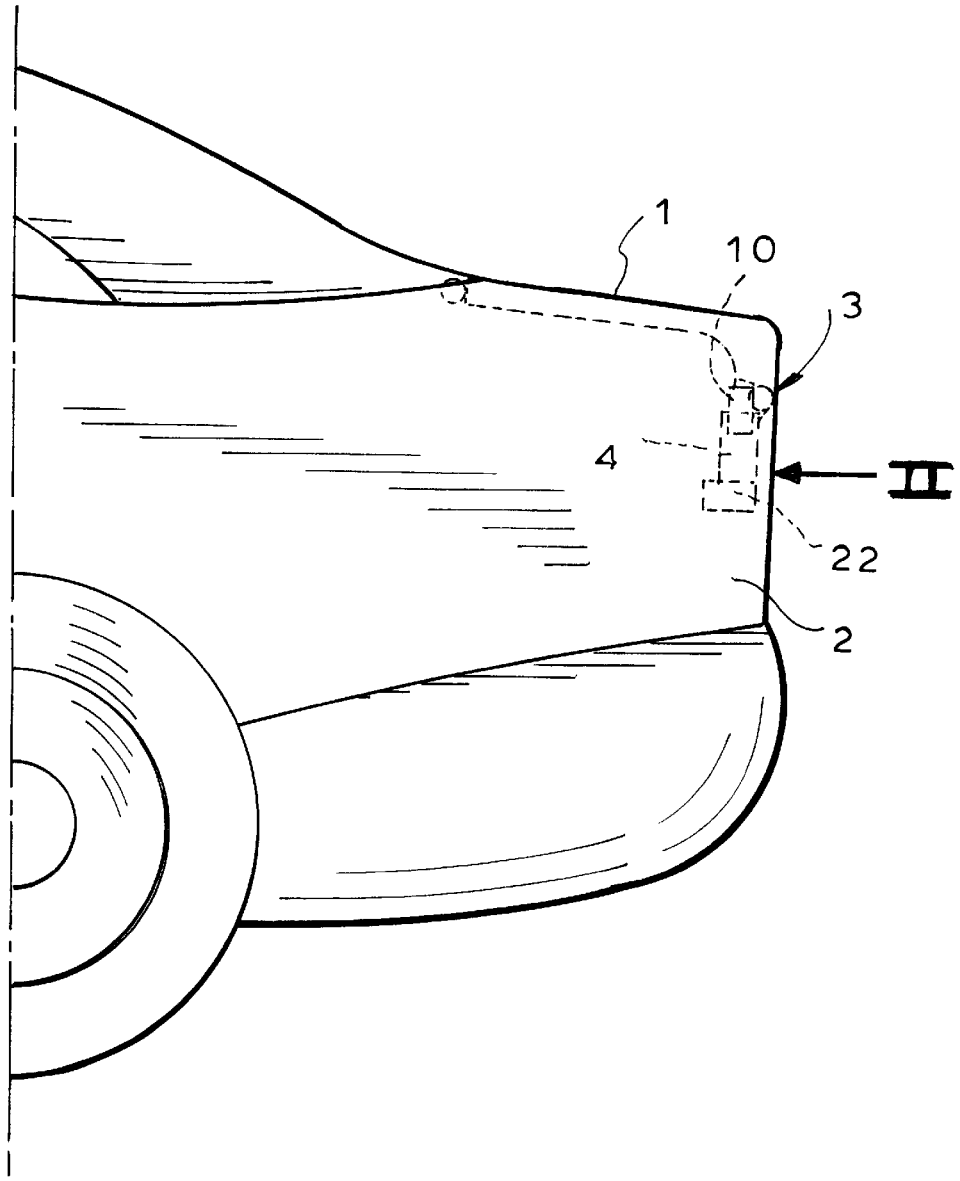
FIG. 1 is a side view of the rear end of a vehicle equipped with the latch according to the invention.

As seen in FIG. 1 a trunk lid 1 of a motor vehicle 2 is provided at a tailgate edge 3 with a latch 4 that serves to hold the lid 1 in the illustrated closed position. As shown in FIGS. 2 through 7, this latch basically comprises a standard housing 5 here fixed in the vehicle 2 but also mountable at the edge of the door 1 and formed with a slot 11 into which a pin or bolt 10 mounted on the door 1 (or on the tailgate 3 if the latch 4 is on the door 1) can be received. A standard lock fork 6 is pivoted at 25 on the housing 5 and a latch pawl 7 is pivoted at 26 on an operating plate 9 that is also pivoted at 25 on the housing 5. An unillustrated spring biases the pawl 7 toward the fork 6 and another spring illustrated schematically at 24 urges the fork 6 rather forcibly in to the open position shown in FIG. 3. An opening lever 8 pivoted at 27 on the plate 9 has an end 8*a* that can engage a pin 28 on the pawl 7 to pivot this pawl 7 out of engagement with the fork 6 to unlock the latch 4.

Figure 2:
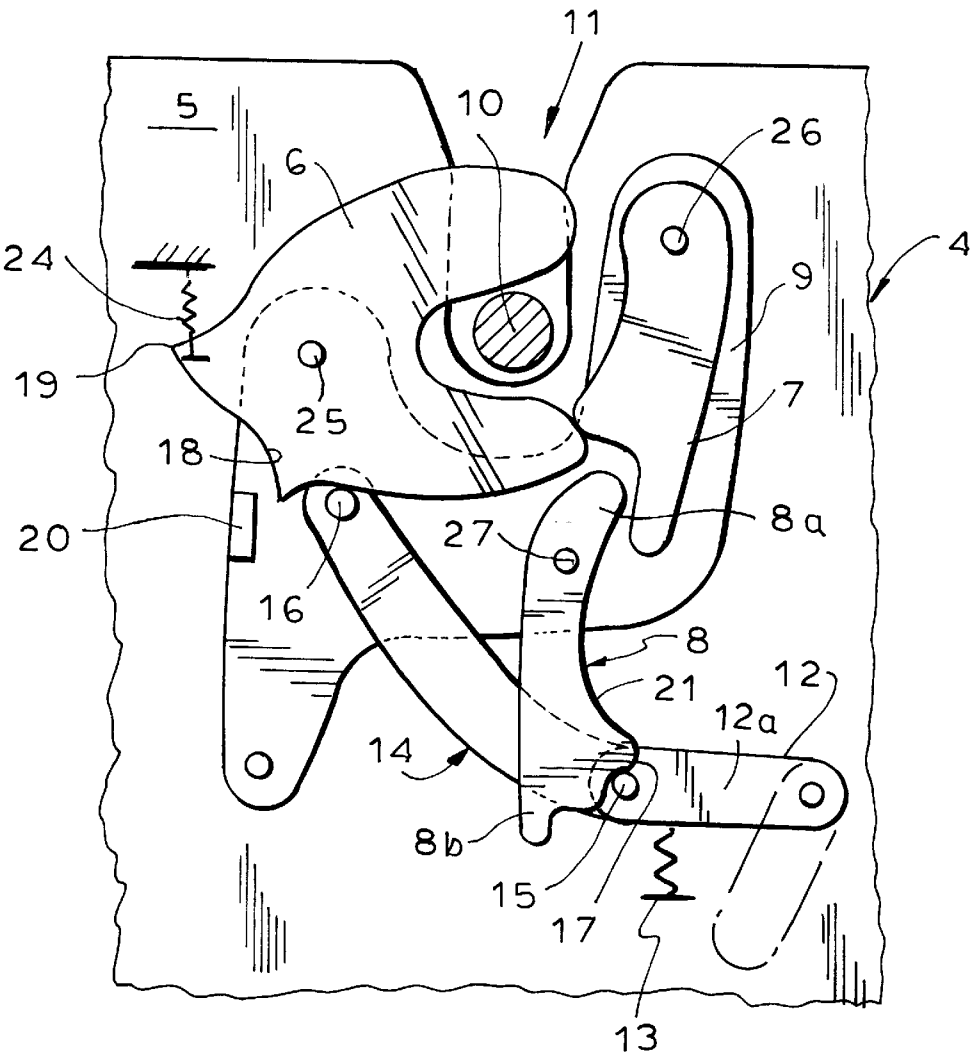
FIG. 2 is a partly schematic and sectional view taken in the direction of arrow II of FIG. 1 of the latch in the closed position.

As better shown in FIG. 3 through 7, where the same reference numerals as in FIGS. 1 and 2 are used for functionally identical if structurally somewhat different parts, the operating plate 9 can be pivoted by a drive indicated schematically at 22 in a clockwise closing direction 32 or an opposite opening direction 33. The closing movement is normally initiated by a switch 31 coupled to the lever 12 and operated when the pawl 7 drops from the releasing position into its holding position retaining the fork 6 against counterclockwise rotation. The fork 6 is formed with a pair of actuating formations 18 and 19 that can interact with a bent-over actuating tab or formation 20 formed on the plate 9.

A manual opening system comprises a lever 12 pivoted at 30 on the housing 5 and having one arm 12*a* connected at 23 via a schematically illustrated bowden cable 34 to an operating handle 35 and another arm 12*b* on whose end a link 14 is pivoted at 29. In a starting position illustrated, for example in FIG. 3, the link 14 rests against an abutment 36 on the housing 5. This link 14 is urged upward as shown in the drawing, that is toward the notch 11, by a biasing spring 13 and carries a pair of actuating formations or pins 15 and 16 that are pressed toward the fork 6 and lever 8 by this spring 13. The pin 15 can slide along an edge 21 of the arm 8*b* of the opening lever 8 and engage in a notch formation 17 cut in the outer end of this arm 8*b*. The pin 16 be pushed down to compress the spring 13 and disengage the pin 15 from the lever 8 by an actuating cam formation 18 on the fork 6.

Starting from the open position of FIG. 3, the latch 4 is closed as follows:

First of all the trunk lid 1 is pushed down until the bolt 10 engages the fork 6 and pivots it against the force of its spring 24 clockwise. Meanwhile the pawl 7 rides against an outer edge of the fork 6 until its end clears the fork 6 and it can move into the position of FIG. 4 in which it bears radially of the pivot 26 on the fork 6 and effectively prevents it from moving counterclockwise. This is the partially latched position in which the bolt 10 is solidly retained, but the lid 1 is not pulled down tight.

Figure 3:
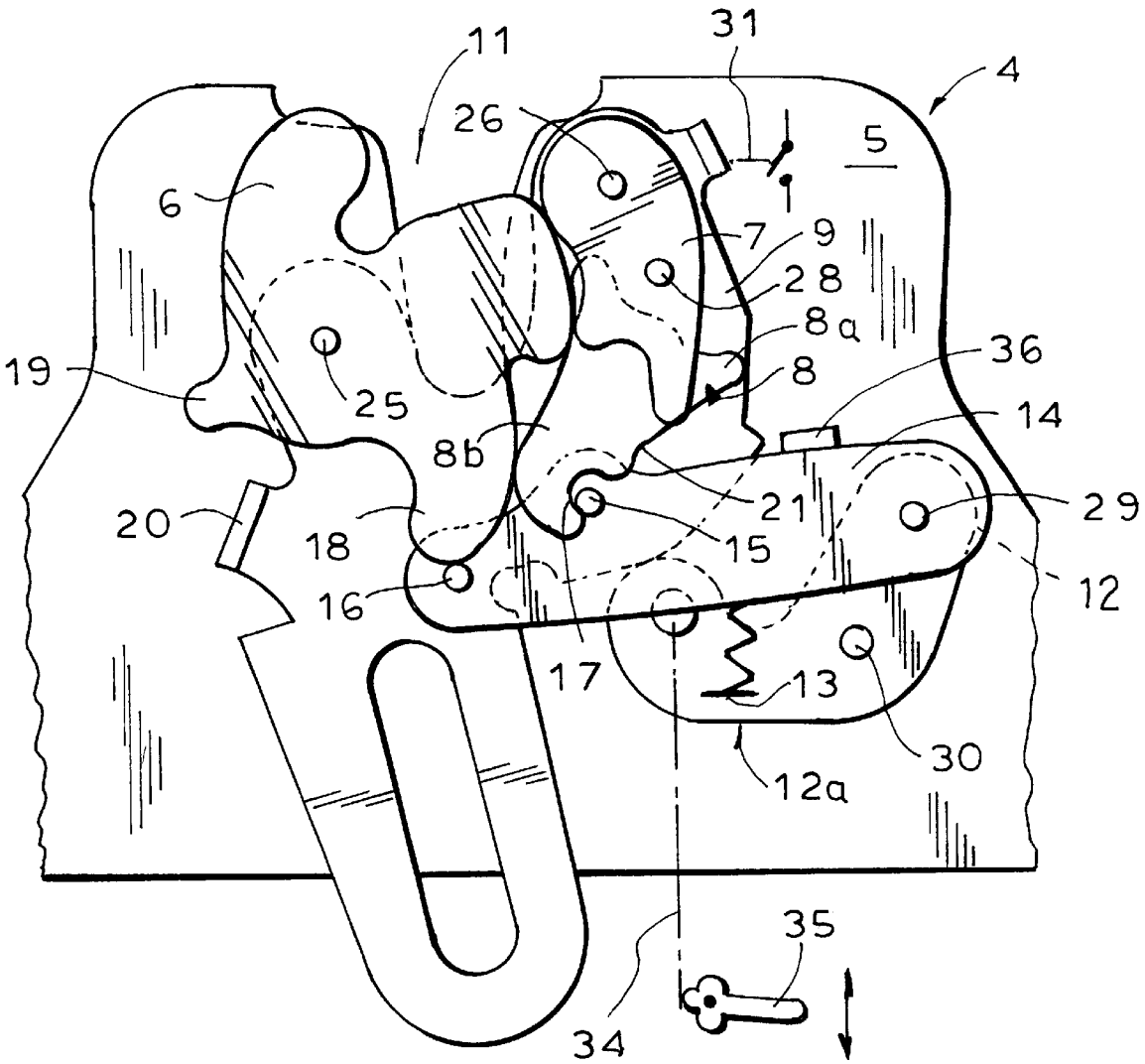
FIG. 3 is a view like FIG. 2 of a latch according to the invention in the open position.
Figure 4:
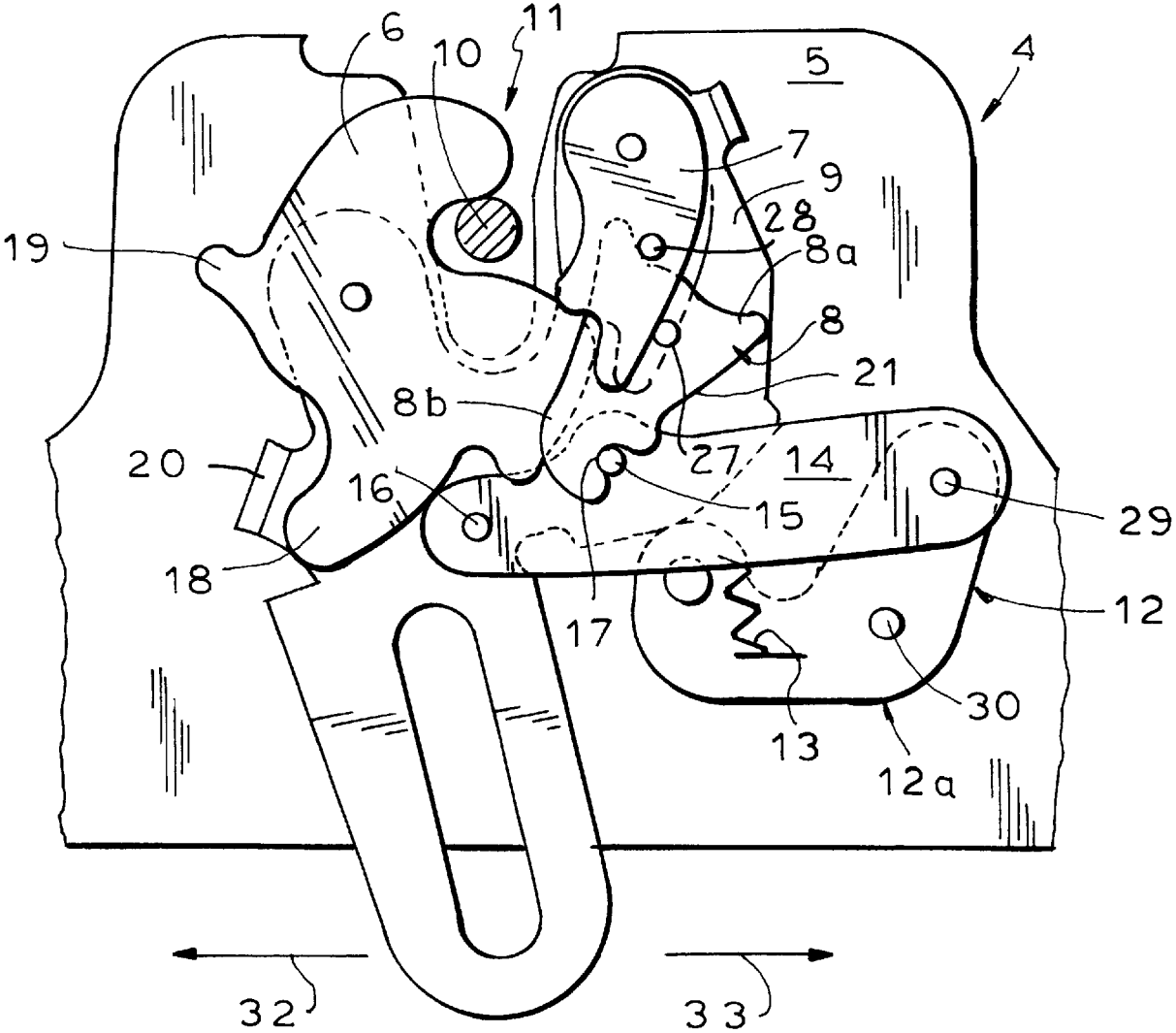
FIGS. 4, 5, and 6 are views like FIG. 3 of the FIG. 3 latch respectively in the partly closed, closed, and partly open positions.
Figure 5:
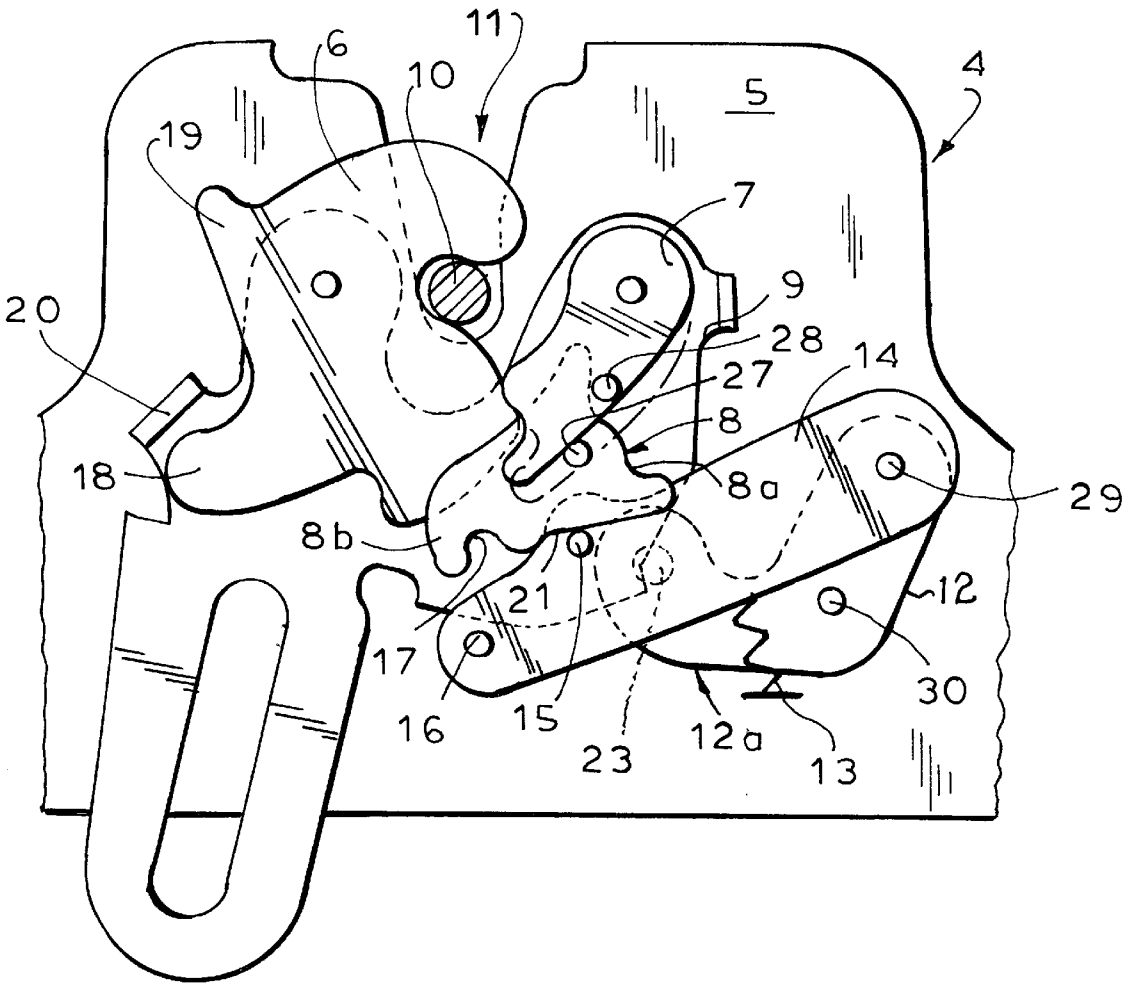

Then, as mentioned above, this movement of the pawl 7 from the releasing position of FIG. 3 to the retaining position of FIG. 4 operates the switch 31 to start the drive 22 and pivot the entire operating plate 9 clockwise in closing direction 32. During this movement the pawl 7 pushes the fork 6 around so that it moves into the fully closed position of FIG. 5, pulling the bolt 10 solidly into the base of the slot or notch 11 and thereby tightly closing the lid 1.

The latch 4 can be opened in two ways.

Figure 6:
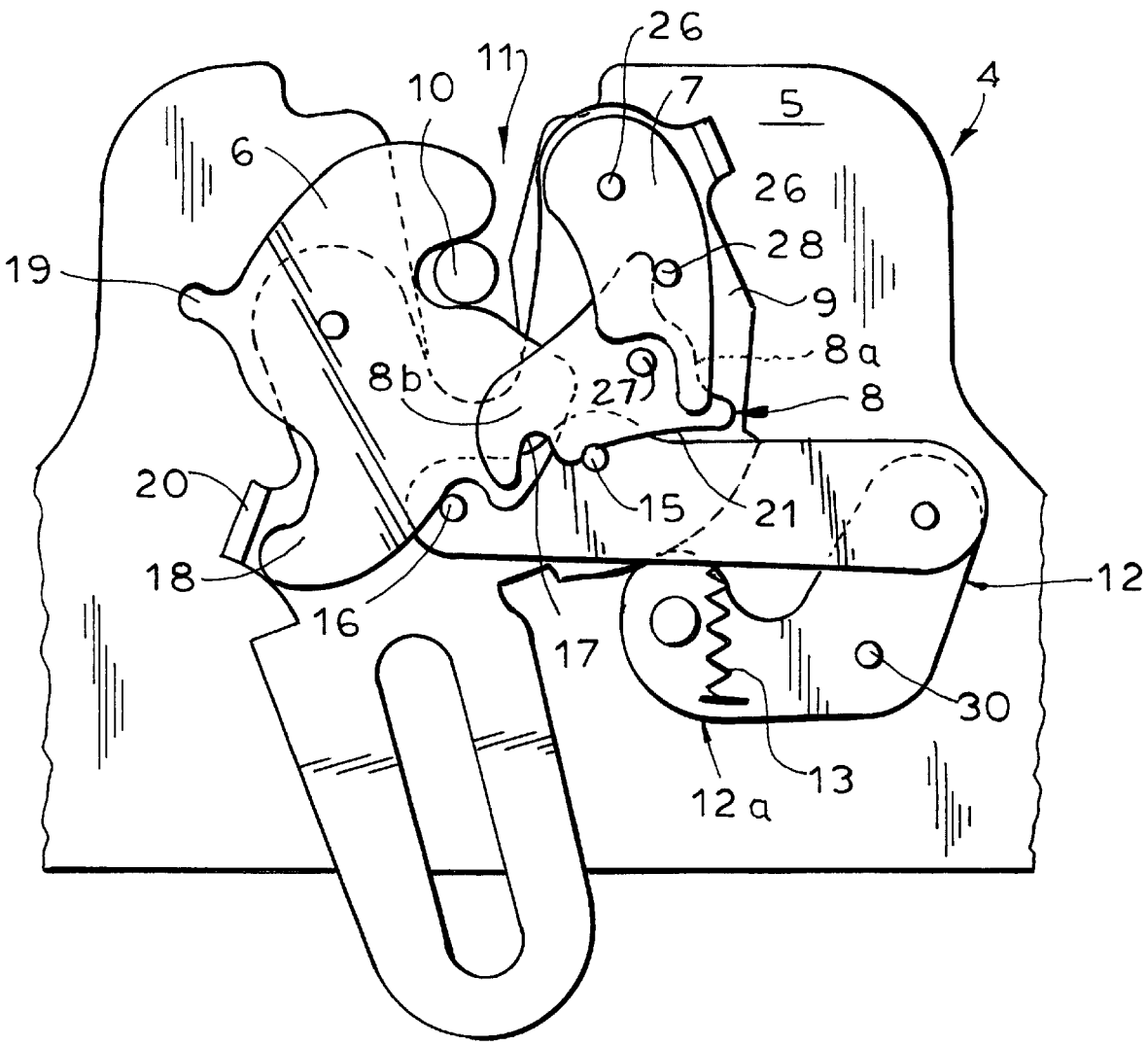

For power opening, the motor 22 pivots the plate 9 counterclockwise, in direction 33. This pushes the opening lever 8 to the right as seen in FIG. 6, thereby causing the currently stationary pin 15 to ride along the edge 21 and pivot the lever 8 clockwise. The arm 8*a* of the lever 8 therefore engages the pin 28 and pushes it back, pulling the pawl 7 away from and freeing the fork 6 which is then free to snap into the open position as shown in FIG. 3. Further pivoting will bring the tab 20 into engagement with the actuating formation 18 and/or 19 to forcible pivot out the fork 6 in case, for instance, the lid 1 is stuck shut and to push down the pin 16 with the formation 18 and allow the lever 8 to return counterclockwise under the force of its unillustrated torque spring.

Once in the fully open position of FIG. 3 the pin 15 which rode along the edge 21 fits in the formation 17 to allow the lever 8 to pivot back counterclockwise and in turn free the pawl 7. This pawl 7, however, remains pushed over until the fork 6 is pivoted into the partially closed position of FIG. 4.

Figure 7:
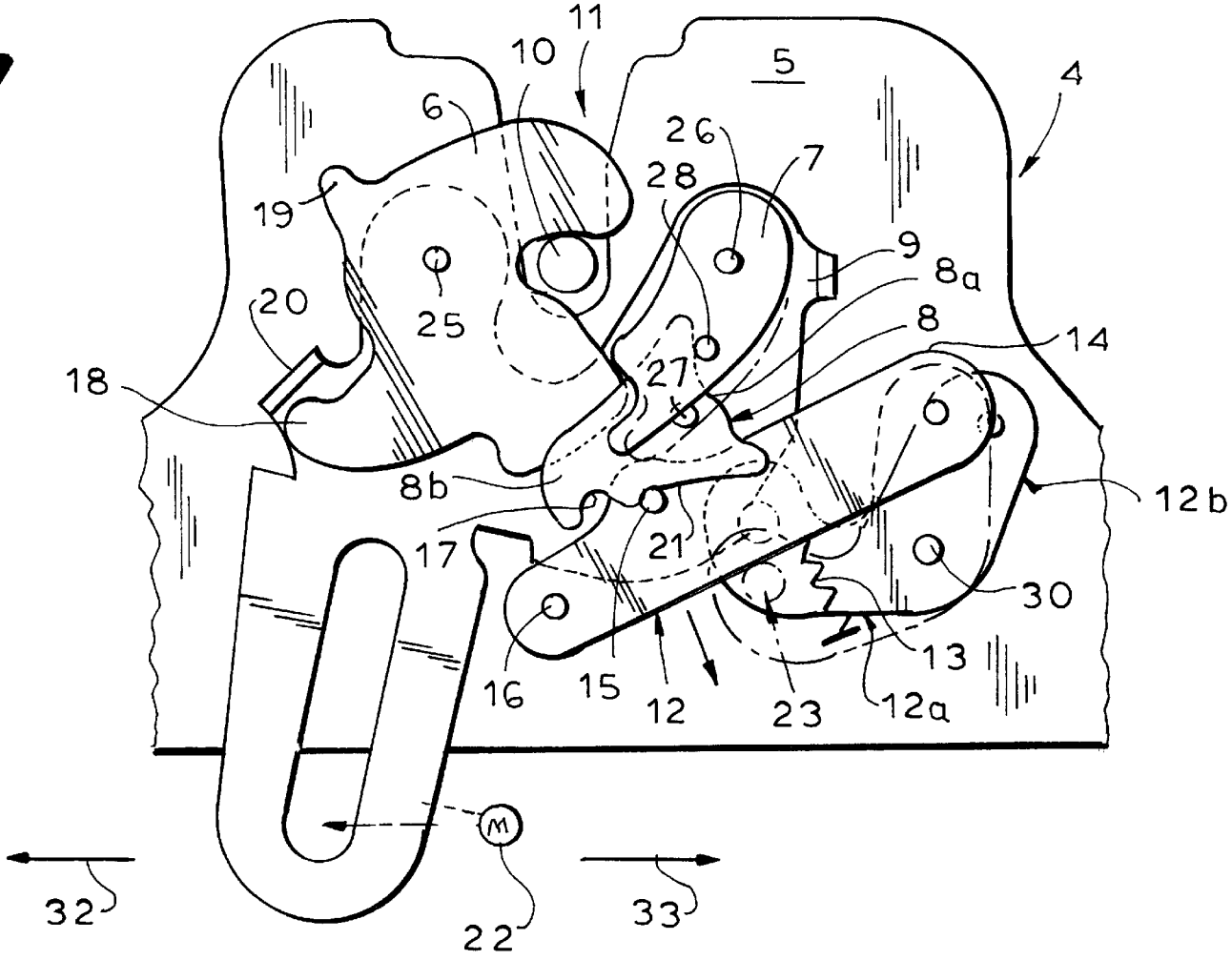
FIG. 7 is a view like FIG. 3 showing the FIG. 3 latch as it is mechanically actuated while in the FIG. 5 closed position.

For manual opening when the latch is closed or at virtually any time the handle 34 is operated to pivot the lever 12 into the dot-dash position of FIG. 7. Such movement will cause the link 14 to slide toward the left, moving the pin 15 along the edge 21 and pivoting the opening lever 8 clockwise to release the pawl 7, the same action as when the motor 22 pivots the plate 9 counter clockwise to move the lever 8 relative to the pin 15.

We claim:

1. A latch for securing an edge of a motor-vehicle trunk lid to an edge of a motor-vehicle body, the latch comprising:

a bolt adapted to be mounted on one of the edges;

a latch housing adapted to be mounted on the other of the edges and having a notch in which the bolt is receivable;

a latch fork pivotal on the housing about a main axis and displaceable between a closed position engaged around the bolt and holding same in the notch and an open position permitting the bolt to enter and leave the notch;

an operating plate pivoted on the housing at the main axis;

a pawl pivoted on the operating plate about a pawl axis offset from the main axis and displaceable between a holding position engaging the fork and, in the locked position of same, retaining the fork in the locked position and a releasing position clear of the fork and permitting same to pivot freely about the main axis;

an opening lever pivotal on the operating plate about a lever axis offset from the main axis, engageable with the pawl, and formed with an actuating formation;

a link member displaceable relative to the housing and having a formation engageable with the opening-lever formation;

a spring urging the link-member formation toward the opening-lever formation;

means including an electrical actuator coupled to the operating plate for pivoting it about the main axis in one direction and thereby, in the holding position of the pawl with the fork in the closed position, pulling the bolt into the notch and in the opposite direction for pressing the formations against each other and thereby pivoting the opening lever into engagement with the pawl and pivoting the pawl into the releasing position; and manual actuating means connected to the link member for pressing the formations against each other and thereby pivoting the opening lever into engagement with the pawl and pivoting the pawl into the releasing position.

2. The motor-vehicle trunk latch defined in claim 1 wherein the opening-lever formation is an edge of the opening lever and the link-member formation is a pin projecting parallel to the axes from the link member.

3. The motor-vehicle trunk latch defined in claim 1 further comprising a second formation on the link member and a formation on the fork engageable with each other in the open position of the fork to hold the first-mentioned formation of the link member out of engagement with the opening lever.

4. The motor-vehicle trunk latch defined in claim 1 wherein the latch fork and operating plate have respective interengageable formations.

5. The motor-vehicle trunk latch defined in claim 1, further comprising an abutment on the housing engageable with the link member in a starting position thereof.

6. The motor-vehicle trunk latch defined in claim 1, further comprising a two-arm lever pivoted on the housing and having one arm pivoted to the link member and another arm connected to the manual actuating means.

* * * * *